United States Patent [19]

Abrahamson

[11] 4,354,443

[45] Oct. 19, 1982

[54] AFGHAN CONSTRUCTION AND METHOD

[75] Inventor: David M. Abrahamson, Woodbury, N.Y.

[73] Assignee: Dason International Products Inc., Hicksville, N.Y.

[21] Appl. No.: 205,382

[22] Filed: Nov. 10, 1980

[51] Int. Cl.[3] ..... B32B 7/08

[52] U.S. Cl. ..... 112/440; D6/267

[58] Field of Search ..... 112/440, 441, 439, 409, 112/262; 28/143; D6/267

[56] References Cited

U.S. PATENT DOCUMENTS

D. 121,954 8/1940 Gorska ..... D6/267

1,629,315 5/1927 Scott ..... 28/143

*Primary Examiner*—Doris L. Troutman

*Attorney, Agent, or Firm*—Blum, Kaplan, Friedman, Silberman & Beran

[57] ABSTRACT

An afghan construction and method of making an afghan is provided. The afghan is made from a plurality of afghan squares, each square having four sides. The sides of the squares which are to lie on the outer periphery of the afghan have a border region formed integrally therewith. The afghan squares are joined together by stitching or the like so that the sides of the squares which include the border region lie on the outer periphery of the afghan.

10 Claims, 5 Drawing Figures

AFGHAN CONSTRUCTION AND METHOD

BACKGROUND OF THE INVENTION

This invention is directed to an afghan construction and method for making an afghan, and, in particular, to an afghan constructed from a plurality of afghan squares, several of the squares having an integrally formed border region.

The conventional afghan is generally formed from crocheted afghan or granny squares. The afghan squares are joined together to form an afghan. However, in order to provide a finished and decorative afghan, a trim border is added around the outer perimeter of the finished afghan after the squares had been joined together. Thus, the prior art afghan was not properly finished and, therefore, not available for resale until the trim border was added to the perimeter of the joined afghan squares.

Since the trim border added to the joined afghan squares is usually crocheted thereto, two separate crocheting operations were required in the prior art afghan, the first being the crocheting of the afghan squares, and the second being the crocheting of the trim border to the outer periphery of the afghan squares after they had been joined together. Under the afghan construction and method of the instant invention, only one crocheting step is necessary.

SUMMARY OF THE INVENTION

Generally speaking, in accordance with the invention, an afghan construction and method of making an afghan, is provided. The afghan is formed from a plurality of afghan sections, each of the sections having four sides. During the crocheting or knitting of the individual squares, a trim region is selectively integrally joined by crocheting or knitting to the sides of the individual sections which are to lie on the outer periphery of the afghan so as to project beyond what would otherwise be the periphery of the afghan section. The sections are then joined together by an appropriate stitching method so that the sides of the afghan sections which include the border region lie on the outer periphery of the afghan.

An afghan construction in accordance with the instant invention is completed and, therefore, ready for distribution upon the joining of the individual afghan sections. Therefore, the additional crocheting step of adding the trim border to the perimeter of the joined afghan sections is no longer necessary since the sections as joined together in accordance with the instant invention have integral border regions.

Accordingly, it is an object of the instant invention to provide an improved afghan construction.

Another object of the instant invention is to provide an improved method of making an afghan from a plurality of afghan sections or squares.

Still another object of the instant invention is to provide an improved afghan construction and method for making an afghan wherein a completed afghan is provided after the afghan sections from which it is formed are joined together.

A still further object of the instant invention is to provide an improved afghan construction and method for making an afghan which reduces the number of steps necessary to complete a finished afghan.

Still other objects and advantages of the invention will in part be obvious and will in part be apparent from the specification and drawings.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
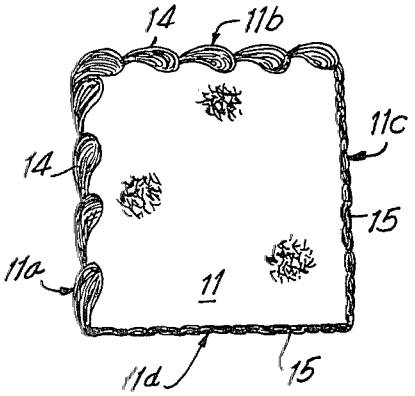
FIG. 1 is a plan view of a corner afghan square constructed in accordance with a preferred embodiment of the instant invention.
Figure 2:
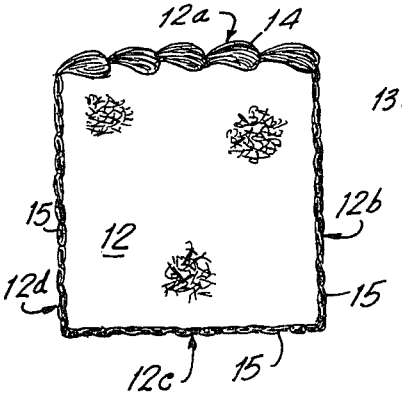
FIG. 2 is a plan view of a peripheral afghan square constructed in accordance with a preferred embodiment of the instant invention.
Figure 3:
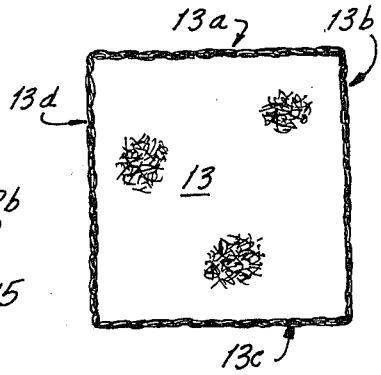
FIG. 3 is a plan view of an interior afghan square utilized in the construction of an afghan in accordance with a preferred embodiment of the instant invention.
Figure 4:
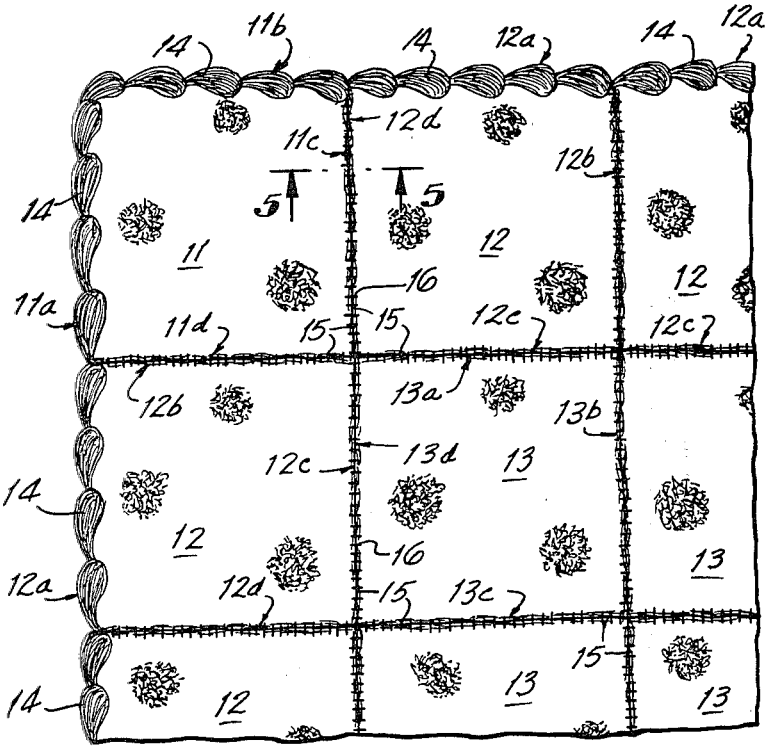
FIG. 4 is a partial plan view of an afghan construction formed from the squares depicted in FIGS. 1 through 3.

Reference is first made to FIGS. 1 through 4, wherein an afghan, generally indicated as 10, and constructed in accordance with a preferred embodiment of the instant invention is depicted. The afghan 10 is formed from its constituent afghan squares 11, 12 and 13 as depicted in FIGS. 1 through 3.

Afghan squares 11, 12 and 13 are the crocheted components which are joined together to form the finished afghan 10. Afghan square 11 is a corner afghan square which includes a first border region 14 formed integrally with two adjacent sides 11*a* and 11*b* of the corner square and a second border region 15 formed integrally with the two other adjacent sides 11*c* and 11*d* of the corner square. The border regions 14 and 15 are generally crocheted to corner square 11 while corner square 11 is itself being formed by crocheting or the like.

First border region 14 is intended to define a peripheral region of the afghan and therefore provided the "finished", decorative appearance desired by consumers and heretofore available by the addition of a separate ornamental border to the entire afghan. The first and second border regions are formed in a single operation. In one embodiment, as depicted in the drawings, second border region 15 is formed of a row of single crochet stitches. Further, first border region 14 is formed of a series scallops. Each scallop is formed, by way of example, of a single crochet stitch, followed by three chain stitches, followed by three double crochet stitches. This pattern is repeated, the last scallop ending in a single crochet stitch. The second border region 15 is of essentially uniform appearance and is suitable for joining to another like border region of another afghan square. The first border region 14 projects outwardly in an irregular fashion to provide an eye-pleasing border appearance and a "finished" look.

Internal peripheral afghan square 12, as depicted in FIG. 2, includes a single side 12*a* in which a first, scalloped border region 14 is formed by crocheting of the like. Second, uniform border region 15 is formed integrally with sides 12*b*, 12*c* and 12*d* of internal peripheral square 12. Interior afghan square 13, as depicted in FIG. 3, is a plain square which does not include any first border portion but does include second, uniform border regions 15 formed integrally with all four sides 13*a*, 13*b*, 13*c* and 13*d* thereof.

Afghan 10 is formed by joining together by an appropriate stitching procedure corner afghan squares 11, internal peripheral afghan squares 12 and interior afghan squares 13. Four corner afghan squares 11 are required, one each of the corner squares 11 forming a corner of the completed afghan 10. It is noted that the first border regions 14 lying on adjacent sides 11*a* and 11*b* of corner square 11 lie on the outer periphery of afghan 10. Depending on the size of the finished afghan, a plurality of internal peripheral afghan squares 12 are required to form the periphery of afghan 10. Particularly, one internal peripheral afghan square 12 is joined to corner square 11 so that the respective second border regions 15 are secured to each other as by stitching 16 (FIG. 5), with side 11*c* of square 11 secured to side 12*d* of the adjacent square 12. Additional peripheral squares are joined in a like manner, one to another, so that the first border regions 14 of the respective corner squares 11 and internal peripheral squares 12 form the periphery of the afghan 10. Another corner square 11 is then joined to the last internal peripheral square 12 on one side of the afghan thereby forming another corner of the afghan, the two adjacent sides 11*a* and 11*b* of corner square 12 being positioned so that first border region 14 lies on the outer periphery of the afghan 10.

The interior afghan squares 13 are joined to the sides 12*c* of internal peripheral squares 12 and to each other to define the interior portion of the afghan, each of the sides of interior square 13 being joined to another afghan square. In this manner, the completed afghan 10 is constructed.

Figure 5:
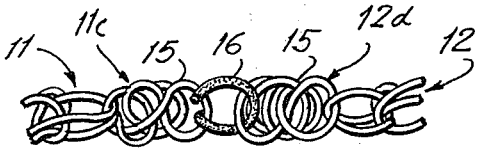
FIG. 5 is an enlarged sectional view taken along lines 5—5 of FIG. 4.

Referring now to FIG. 5, the manner of stitching together the individual afghan squares is depicted. A stitching 16 is utilized to join together the fabrics of adjacent afghan squares. It is noted that only the sides of each of the afghan squares 11, 12 and 13 which do not include a first border region 14, are stitched together as depicted in FIG. 5. Because of the uniform nature of second border region 15, a tight and eye-pleasing bond between the respective squares is produced.

In an exemplary embodiment, each afghan square is individually hand crocheted from either natural or synthetic materials. Preferably, 100% acrylic is utilized in forming the afghan squares. In an exemplary embodiment, each square has five inch sides. As an example, consider constructing a forty-one inch by sixty-one inch afghan. Such as afghan would require the sewing together of ninety-six five inch afghan squares, thereby forming an eight square by twelve square pattern. Four corner afghan squares 11 are required which will form the four corners of the completed afghan. Thirty two internal peripheral afghan squares 12 are required which will lie intermediate the corner squares on the periphery of the afghan 10. Finally, sixty interior afghan squares 13 are required to fill in the body of the completed afghan. The extra inch allocated to each side measurement is due to the greater width of the first border regions 14 formed around the outer periphery of the completed afghan by the joining together of the constituent afghan squares, and due to the stitching connection between the squares. The individual component afghan squares are preferably joined together by a hand-sewing process to form the finished product.

An afghan formed from the afghan squares 11, 12 and 13, in the manner discussed above, will be completed upon the joining together of the individual component afghan squares since the desired "finished" border is pre-formed in the sides of the constituent afghan squares which will lie on the outer periphery of the afghan. Accordingly, the step of adding a trim border to the afghan after the squares have been joined together is no longer necessary in view of the construction and method according to the instant invention. By constructing an afghan in accordance with the instant invention, a decorative afghan is formed which can be utilized by the consumer as a decorative bed or furniture covering, as a blanket, or the like. While afghan squares are depicted, any shape normally used in afghan constituents, such as rectangular shaped constituents, may be used. Further, first border region 14 may be of any eye-pleasing, border-forming configuration and is not limited to scallops as depicted.

It will thus be seen that the objects set forth above, among those made apparent from the preceding description, are efficiently attained and, since certain changes may be made in carrying out the above method and in the articles set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An afghan comprising a plurality of peripheral afghan constituents; a plurality of interior afghan constituents; and means for joining said peripheral and interior constituents in side-by-side relation into an afghan with said peripheral afghan constituents defining the periphery of said afghan, each of said peripheral afghan constituents being formed integrally with a first border region unconnected to another of said constituents and defining the outer border of said afghan and a second border region at which said peripheral afghan constituents is joined to other of said constituents, said first border regions having a configuration at least in part wider and different from said second border regions to define a simulated border for said afghan.

2. The afghan as claimed in claim 1, wherein said first border regions are defined by a repetitive pattern projecting in a direction away from said internal afghan constituents.

3. The afghan as claimed in claim 1, wherein said first border regions are defined by an outer edge not lying on an essentially straight line, at least portions of said first border regions projecting in a direction away from said internal afghan constituents.

4. The afghan as claimed in claims 1, 2 or 3, wherein each of said interior afghan constituents includes a border region at which it is joined to other interior afghan constituents or to second border regions of said peripheral afghan constituents, said border regions of said interior afghan constituents and said second border regions of said peripheral afghan constituents being of the same configuration.

5. The afghan as claimed in claim 4, wherein the border regions of said interior afghan constituents and the second border regions of said peripheral afghan constituents are defined by outer edges lying on straight lines.

6. The afghan as claimed in claim 5, wherein each of said afghan constituents defines a rectangle.

7. The afghan as claimed in claim 5, wherein each of said interior afghan constituents substantially defines a square, each of said peripheral afghan constituents substantially defining a square having the edge or edges thereof forming said first border region projecting outwardly beyond the dimension of the square defined by the edges forming the second border region.

8. The afghan as claimed in claim 7, wherein said peripheral afghan constituents include four corner afghan squares, two adjacent sides of each side corner square having said first border region formed integrally therewith, the other of the sides of each corner square having said second border region formed integrally therewith, and a plurality of internal peripheral afghan squares, one side of each said internal peripheral afghan square having said first border region formed integrally therewith, the other three sides of each side internal peripheral afghan square having said second border region formed integrally therewith.

9. The afghan as claimed in claim 1, wherein said joining means is a stitching.

10. The method of making an afghan comprising forming a plurality of interior afghan squares each having a border region of essentially uniform configuration; forming a plurality of internal peripheral afghan squares each having one side defining a first border region and three sides defining a second border region; forming four corner afghan squares each having two adjacent sides defining a first border region and two adjacent sides defining a second border region, said second border regions of said corner and internal peripheral afghan squares being of essentially uniform configuration, said first border regions of said corner and internal peripheral afghan squares being of a configuration wider and different from the configuration of said first border regions of said corner and internal peripheral afghan squares, said first border regions projecting outwardly beyond the square defined by the dimensions of the sides defining said second border regions; and joining said afghan squares so that said sides of said corner and internal peripheral afghan squares defining said second border regions form a peripheral border for said afghan.

* * * * *